United States Patent [19]

Corry

[11] 4,356,063

[45] Oct. 26, 1982

[54] PRE-HEATED COAL SUPPLY SYSTEM FOR A COKING OVEN BATTERY

[75] Inventor: David B. Corry, Blackpool, England

[73] Assignee: Otto-Simon Carves Limited, Stockport, England

[21] Appl. No.: 193,073

[22] Filed: Oct. 2, 1980

[30] Foreign Application Priority Data

Oct. 12, 1979 [GB] United Kingdom ..... 7935523

[51] Int. Cl.[3] ..... C10B 5/00

[52] U.S. Cl. ..... 201/41; 202/262

[58] Field of Search ..... 201/120, 36, 38, 41; 202/262, 263

[56] References Cited

U.S. PATENT DOCUMENTS 4,139,419 2/1979 Limberg ..... 202/262
4,176,011 11/1979 Knappstein ..... 202/262
4,202,733 5/1980 Luke et al. ..... 201/1
4,231,845 11/1980 Vander et al. ..... 201/1
4,251,207 2/1981 Beck et al. ..... 202/262

*Primary Examiner*—Norman Yudkoff
*Attorney, Agent, or Firm*—LeBlanc, Nolan, Shur & Nies

[57] ABSTRACT

A method of operating a conveying and storage system associated with a coal pre-heating installation, supplying pre-heated coal to a coking oven battery, the system including a series of conveyors (16, 17, 19, 20) for carrying coal from the pre-heating installation (10, 11) into a plurality of storage hoppers (21) and metering bins (22), a plurality of interconnecting pipes (29, 30, 31, 46, 47) ensuring maintained flow of gases through the system, there being an inert gas generator (26) for introducing inert gas into the series of conveyors, the method including the step of discharging a mixture of inert and combustible gases from the system into a gas collecting main (24) of the coking oven battery (23) to which pre-heated coal is supplied from the metering bins (22).

9 Claims, 1 Drawing Figure

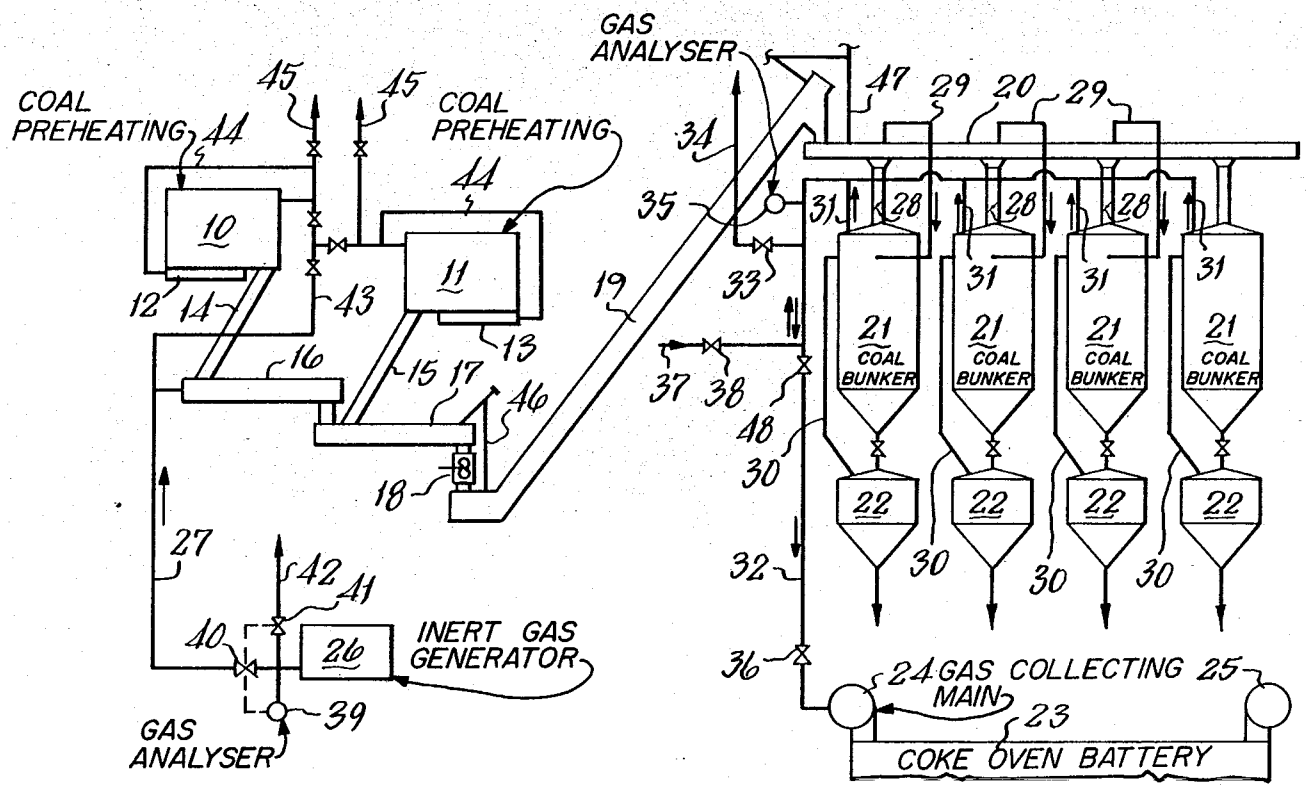
COAL BUNKER
COAL BUNKER
COAL BUNKER
COAL BUNKER
GAS COLLECTING MAIN
COKE OVEN BATTERY
GAS ANALYSER
COAL PREHEATING
COAL PREHEATING
INERT GAS GENERATOR
GAS ANALYSER

PRE-HEATED COAL SUPPLY SYSTEM FOR A COKING OVEN BATTERY

This invention relates to coking ovens and in particular, a system for handling preheated coal to be carbonised in a coking oven battery.

Several processes are known for the pre-heating and charging of coking coals into slot-type coking ovens. These processes differ both in the method in which the coal is pre-heated and also the method by which the coal is charged into the oven chambers.

The pre-heating plant may consist of one or more entrainment heating stages, or of other arrangements such as a fluidised bed system. The pre-heated coal can be charged into the ovens by several different systems including, for example, a lorry car, a steam or gas operated pipe line conveyor system, or a mechanical conveyor system. All of these systems essentially have in common the facility to store pre-heated coal to provide a transition between the continuous operation of the pre-heating plant, and the batch operation of the charging system. In all of the systems the equipment used for conveying, metering and charging the coal is kept separate from the pre-heating plant itself so that the process gas is circulated within the pre-heating plant and usually isolated from further equipment downstream. However, it is necessary to maintain the pre-heated coal in an inert environment whilst it is conveyed and stored, and this is generally by the injection of inert gases into the conveying and storage systems. The inert gases can be provided, for example, by combustion of a fuel gas in near-stoichiometric conditions; or it can be provided by nitrogen where nitrogen is available in reliable quantities; or it can be provided by steam where steam is available in reliable quantities; or it can be provided from any other source provided the gas has a sufficiently low oxygen content.

Usually, coking coals are pre-heated to a temperature of approximately 250° C. At this temperature the coal does not usually give off very large volumes of combustible gases, but recent experience has demonstrated that some coals do give off significantly large volumes of combustible gases even when the coal is pre-heated to low temperatures. In this case, therefore, the inert gas which is used to blanket the pre-heated coal in the conveying and/or storage systems becomes contaminated by combustible gases. If these contaminated gases are vented to atmosphere in the usual way there is the danger of atmospheric pollution, and the disadvantage of losing valuable fuel components in the combustible gases.

An object of the present invention is to provide a process whereby the inert gases from the storage and/or conveyor system of a coal pre-heating installation can be recovered without the loss of the combustible components and without atmospheric pollution.

According to the present invention there is provided a method of operating a conveying and/or storage system associated with a coal pre-heating installation, for supplying pre-heated coal to a coking oven battery, comprising the steps of supplying inert gas to said system and discharging therefrom a mixture of inert and combustible gases, said discharged gas mixture being passed to a gas collecting main of the coking oven battery to which the pre-heated coal is supplied.

An embodiment of the invention will now be described, by way of example only, with reference to the accompanying drawing, which illustrates schematically a coal pre-heating plant, a conveying and storage system, and a coking oven battery.

Referring now to the drawing, the system comprises two coal pre-heating plants 10 and 11 fired by furnaces 12 and 13 respectively and arranged to discharge, via conveyor chutes 14 and 15 respectively, into a pair of conveyors 16 and 17. The pre-heating plants 10 and 11 operate alternately and never simultaneously.

A stream of pre-heated coal conveyed by the conveyors 16, 17 passes through a mixer 18 and then is carried by a conveyor 19 to a further conveyor 20 disposed above a series of bunkers 21 where the pre-heated coal is stored prior to being delivered by metering bins 22 into the coking oven battery 23.

The battery 23 is connected to a pair of gas collecting mains 24 and 25, the main 24 being connected to the oven chambers of the battery 23 during chaging thereof with pre-heated coal thus to receive the rush of dust-laden gases emitted during charging, while the collecting main 25 is connected to the oven chambers for a substantial part of the remainder of the carbonising period.

An inert gas generator 26 supplies inert gas via a duct 27 to the conveyor 16. Inert gas injected into the conveyor system passes through the latter and into the conveyor 20 above the storage bunkers 21.

Except for the storage bunker 21 at the extreme right-hand end of the drawing, pre-heated coal is delivered into the bunkers selectively by means of shut-off valves 28. As the right-hand end bunker 21 receives that proportion of the coal from the conveyor 20 which remains after the other bunkers have been filled, no shut-off valve is necessary. To ensure that the inert gas flow from the conveyor 20 into all of the bunkers 21 is maintained irrespective of the condition of the control valves 28, gas ducts 29 are provided for all except the right-hand bunker, to permit the free passage of gas into the bunkers. Further gas lines 30 are provided between the bunkers 21 and their associated metering bins 22.

Inert gas flow from the storage bunkers 21 is via outlet ducts 31 which connect to a main output line 32 connected to the charging main 24 of the coking oven battery 23. Also connected to the line 32 via a bleed valve 33 is a line 34 to atmosphere. A gas analyser 35 is connected to line 32 and operably connected to a shut-off valve 36, in the line 32, and to bleed valve 33. The analyser 35 thus serves, when necessary, to divert gases from the line 32 to atmosphere via the line 34. The conditions of valves 33 and 36 are influenced also by the pressure and temperature of the gases within the system, suitable means being provided to sense these conditions. A supply of steam to purge the system when necessary, is connected to a line 37 which is capable of connection via a valve 38 to the line 32.

In the operation of the system, inert gases are produced by the generator 26 at a temperature of approximately 250° C. thus to prevent condensation and subsequent operating difficulties within the system. The gases supplied by the generator 26 are sensed by a gas analyser 39 and if the content or condition of the gases is unsatisfactory for supply to the conveying and storage systems, a valve 40 in the duct 27 is closed and a valve 41 in a vent line 42 to atmosphere, opened. Once the gas analyser 39 senses a satisfactory condition valve 41 is closed and valve 40 is opened to permit the gas to enter the system via line 27.

In the event of a breakdown of the inert gas generator 26 a supply of at least substantially inert gas from whichever of the pre-heating plants 10 and 11 is operating, can be supplied to the conveyor 16 via a line 43. Normally these hot gases, when not required in line 43, are recycled, in part via a duct 44 to the furnace 12 or 13 for the pre-heating plant. Thus the furnace is supplied with pre-heated gas. Some of the gases issuing from the pre-heating plant are vented to atmosphere via one or more stacks 45.

When the whole apparatus is initially started up it is important that the gases issuing into line 32 are vented to atmosphere via line 34 whilst the metering bins 22 are pre-purged.

When the analyser 35 senses the correct conditions, and provided that the pressure in the system is correct and the temperature of the gas is sufficient to avoid condensation, then valve 36 opens, and gases pass into the charging main 24.

If during operation of the system the gas conditions in line 32 vary beyond specified limits, then valve 36 is closed to prevent the gases from entering the charging main 24.

Bypass ducts 46 and 47 are provided to maintain the flow of gases from one conveyor system to the next in the event of a blockage in the transmission pipes between the two.

It will be appreciated that several advantages are attained according to the invention. The combustible gases produced by the pre-heated coal during its conveyance and storage are transferred into the main foul gas system of the coking oven battery, and thus can be recovered in the by-product plant. In order that this system can operate efficiently it is necessary for the inert gas in the system to be maintained at a pressure above that within the charging main 24 and this pressure is ensured by the provision of a pressure control valve 48 between the system and the charging main. Thus, a further advantage provided by this system is experienced in the charging main 24 as it is necessary usually to keep this main hot at all times and to ensure continuous flow of gases therethrough to prevent operational difficulties. Conventionally this can be achieved only by leaving two or more oven chambers permanently connected to the charging main, and this presents a disadvantage since the permanent connection of an over chamber to this main results in the deposition of excessive tar into the charging main with consequential difficulties in recovering the coal dust and contaminated tar therefrom. By this system, the continuous feed of hot gases from the line 32 into the charging main 24 avois the necessity of leaving the oven chambers open to the main 24 after the initial charging time; thus operation of the main and recovery of coal dust therefrom is considerably facilitated.

What is claimed is:

1. A method of operating a conveying and/or storage system for supplying pre-heated coal to a coking oven battery, comprising the steps of supplying inert gas to said conveying and/or storage system and discharging therefrom a mixture of inert and combustible gases, said discharged gas mixture being passed directly to a gas collecting main of the coking oven battery without passing through the coking oven battery to which the pre-heated coal is separately supplied substantially without the inert gas.

2. A method according to claim 1, wherein said inert gas is supplied to said system substantially at the commencement of passage of coal from the pre-heating installation through the system.

3. A method according to claim 1, wherein said gas mixture is maintained in said system at a pressure above that within the gas collecting main.

4. A method according to claim 1, wherein the flow of inert gas through the system is maintained in the event of a blockage by the coal.

5. A method according to claim 1, comprising the steps of conveying preheated coal to the coking ovens, introducing inert gas from a source into the pre-heated coal being conveyed and maintaining flow of said inert gas.

6. In a conveying and storage system for supplying pre-heated coal to a coking oven battery, the system including conveying means for carrying pre-heated coal from a pre-heating installation to a plurality of storage hoppers connected to a plurality of metering bins for selectively feeding the pre-heated coal to the coking ovens of the battery, an inert gas generator connected to the conveying means, means for maintaining the flow of inert gas through the system, and means connected to the conveying means for discharging the gas into a gas collecting main of the coking oven battery, a method of recovering gases from the storage and conveying system without loss of the combustible components of the gases and without atmospheric pollution, comprising the steps of: supplying inert gas to the system from the generator; discharging therefrom a mixture of inert and combustible gases; and passing the discharged gas mixture directly to a gas collecting main of the coking oven battery without passing through the coking oven battery to which the pre-heated coal is separately supplied substantially without the inert gas.

7. A method according to claim 1 wherein the inert gas is supplied from a source independent of the conveying and/or storage system and independent of the source of pre-heated coal.

8. A method according to claims 1 or 6, wherein said inert gas is analysed prior to introduction into the system, and if unsatisfactory is otherwise disposed of.

9. A method according to claims 1 or 6, wherein said gas mixture is analysed prior to introduction into the gas collecting main, and if unsatisfactory, is otherwise disposed of.

* * * * *